United States Patent [19]

Dollenmayer

[11] 4,289,412

[45] Sep. 15, 1981

[54] AUTOMATIC TYPEFONT LOADER

[75] Inventor: William L. Dollenmayer, Versailles, Ky.

[73] Assignee: International Business Machines Corporation, Armonk, N.Y.

[21] Appl. No.: 98,288

[22] Filed: Nov. 28, 1979

[51] Int. Cl.[3] ..... B41J 1/32

[52] U.S. Cl. ..... 400/171; 400/144.3; 400/175

[58] Field of Search ..... 400/144.2, 144.3, 151, 400/151.1, 171, 172, 175

[56] References Cited

U.S. PATENT DOCUMENTS

| | | | |
|---|---|---|---|
| 3,645,372 | 2/1972 | Noell et al. | 400/151 X |
| 3,892,303 | 7/1975 | Willcox | 400/171 |
| 4,026,403 | 5/1977 | Inose et al. | 400/144.2 X |

OTHER PUBLICATIONS

IBM Technical Disclosure Bulletin, "Multiple Print Wheel Font Changing Apparatus", Hunt, vol. 22, No. 10, Mar. 1980, pp. 4349–4350.

*Primary Examiner*—Ernest T. Wright, Jr.

*Attorney, Agent, or Firm*—John W. Girvin, Jr.

[57] ABSTRACT

An automatic typefont loader is sequenced to change the printwheel typefont of a printer. An elongated rack supports plural picker holders along its length and is normally located beneath the platen of the printer. Typefonts to be exchanged are held by the picker holders. During an exchanging sequence, the typefont carrier which is positioned along the platen to effect printing at discrete printing positions is positioned to a discrete printing position adjacent an empty picker holder for a typefont unloading operation. The elongated rack is then elevated so that the empty picker holder contacts the typefont. The typefont is removed from its carrier by moving the typefont carrier perpendicular to its normal motion. The picker holder rack is then withdrawn and the now empty typefont carrier is positioned to a second discrete printing position adjacent a selected typefont located on a picker holder. The picker holder rack is elevated and the typefont carrier moves toward the selected picker holder to retrieve a typefont. The operation is completed with the withdrawal of the rack to its normal position beneath the platen.

12 Claims, 10 Drawing Figures

AUTOMATIC TYPEFONT LOADER

BACKGROUND OF THE INVENTION

1. Field of the Invention

This invention relates to automatic typefont changing apparatus for a printer such as a daisy wheel printer employed as a typewriter.

2. Description of the Prior Art

Prior art serial printers and typewriters employing a single element typefont have met wide acceptance in the marketplace because of their ability to accept different typefonts each bearing different type styles. Typefonts have generally been interchanged by the machine operator who manually disengages the loaded typefont from the typefont carrier and inserts a different one when a type style change is desired. Automatic typefont changers for such serial printers have also been proposed in order to alleviate this operator burden. U.S. Pat. No. 3,645,372 is exemplary of an automatic type element changing mechanism. This mechanism includes a carousel on which various type elements are mounted and which operates in conjunction with a loading mechanism to receive typefonts from and to present typefonts to the loading mechanism. The device is located external to the typewriter, consists of numerous parts and is quite large in size. U.S. Pat. No. 3,892,303 also describes a typefont changing apparatus employing a carousel type of loading mechanism. The typefont carrier is moved beyond the region of the platen whereat it can load and unload a typefont from the carousel mechanism. This apparatus necessarily increases the dimensions of the typewriter or printer apparatus employing it. U.S. Pat. No. 4,026,403 teaches a carousel type loader for a daisy printwheel printer which is incorporated under the covers of the printing machine. This device, like the other carousel devices, occupies a great amount of space adding to the height profile of the printing machine.

SUMMARY

In order to overcome the above noted shortcomings of the prior art and to provide the printer with an under-the-cover automatic typefont changing apparatus which occupies a minimum amount of space and which does not cause a substantial change in the external dimension of the printing apparatus, the present invention provides a typefont storage rack which extends under the platen of the printer. The storage rack contains a plurality of picker holder members each containing a typefont. When it is desired to change typefonts, the typefont carrier is positioned along the platen to a location opposite the picker holder. The picker holder rack is then elevated to receive or unload a typefont. Accordingly, it is an object of the invention to provide an automatic changing apparatus located under the covers of a printer which occupies the normally unused space below the platen when not in use. It is a further object of the invention to utilize the print positioning system to precisely position the typefont holder adjacent to a preselected typefont for loading therewith.

The foregoing and other features and advantages of this invention will be apparent from the following more particular description of the preferred embodiment of the invention as is illustrated in the accompanying drawing.

IN THE DRAWING

FIGS. *9a* and *9b* are a logic diagram of the logic employed to effect a typefont loading operation.

DESCRIPTION

Figure 1:
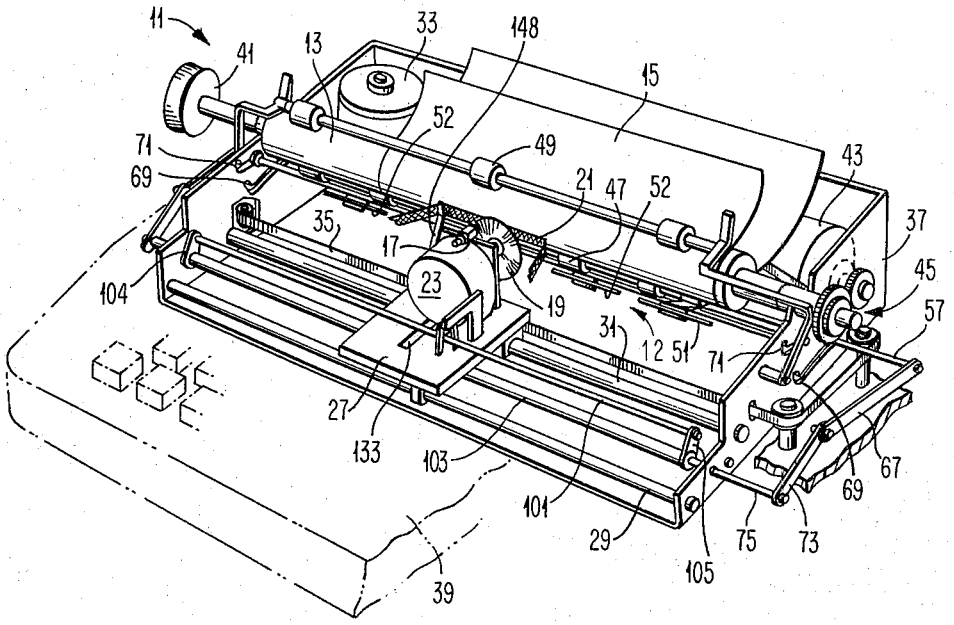
FIG. 1 is a perspective sketch of a typewriter/printer including the automatic typefont loader of the present invention.

Referring now to the drawing, and more particularly to FIG. 1 thereof, a perspective sketch of a typewriter/-printer 11 including the automatic typefont loader 12 of the present invention is depicted.

Typewriter/printer 11 includes a cylindrical platen 13 about which a print receiving medium such as a sheet of paper 15 may be wrapped to receive printing thereon. Printing is effected when the hammer unit 17 is actuated to force a selected type petal of the daisy wheel typefont 19 to strike the ink ribbon 21 which in turn strikes paper 15 creating an image. The selection motor 23 acting as a typefont carrying means effects character selection by rotating to effect the positioning of a selected type petal adjacent to the hammer unit 17.

The selection motor 23, ribbon 21, typefont 19 and hammer unit 17 are mounted on a print carrier 27 which moves over fixed guide rails 29 and 31 in a direction which parallels the length of the platen 13. A stepper motor 33 is rotated thereby effecting motion of a belt 35 which is connected thereto. The belt 35 is also connected to the print carrier 27 causing its corresponding motion along the length of the platen 13. Thus, rotation of the stepper motor 33 positions the print carrier 27 and thus a selected type petal at discrete printing positions along the length of the platen 13.

A frame 37 supports the fixed guide rails 29, 31 and the platen 13. The typewriter/printer 11 may also include a keyboard 39 which is also supported by the frame 37. The platen 13 may be rotated manually upon rotation of the platen knob 41 or automatically by a drive motor 43 connected to gear train 45. Paper feed rolls 47 are located on the underside of platen 13 and are spring loaded thereagainst so that the rotary motion of the platen 13 advances the paper 15 in an upward direction. Conventional paper bails 49 cause the paper 15 to follow the contour of the platen 13 to further facilitate printing thereon.

Figure 2:
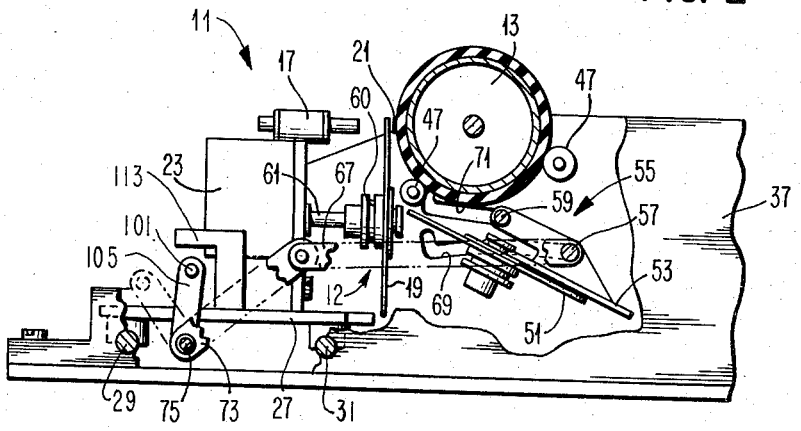
FIG. 2 is a side view, partially in section, of a typewriter/printer including the automatic printwheel loader of the present invention.

Additional typefonts 51, 52 are depicted in their stored condition located under the platen 13. Referring now to FIG. 2 of the drawing, a side view, partially in section of the typewriter/printer 11 including the automatic typefont loader 12 of the present invention is depicted. The additional typefont 51 is stored on a picker holder 53 which is in turn mounted on a rack 55 comprising tubular rack members 57 and 59 which are fixedly attached to one another. A picker holder 53 is provided for each typefont 19, 51, 52 depicted in FIG. 1.

It should be noted at this point that the typefont 19 is slidably mounted at its hub 60 on the motor shaft 61 of the selection motor 23. As thusly mounted, rotation of the motor shaft 61 effects corresponding rotation of the typefont 19 thereby effecting character selection. The typefont 19 is oriented in a vertical position so as to effect printing at the nine o'clock position on the platen 13 as viewed. Such a printing position provides the maximum visibility to an operator keyboarding data. The vertically oriented daisy wheel typefont 19 thus extends downward below its axis of rotation about the motor shaft 61. The additional typefont 51 is stored at a location beneath the platen 13 and at an acute angle with the vertical. The normal geometry of the printing device requires that there be space beneath the platen 13. It is this space which is effectively utilized to store additional typefonts 51, 52 without thereby necessitating an increase in the dimensional size of the typewriter/printer 11.

In order to move the additional typefont 51 to a position whereat it can be loaded onto the motor shaft 61, control linkage 67 is provided. The control linkage 67 is pinned to the tubular rack member 57 so that leftward motion thereof causes the tubular rack member 57 and the tubular rack member 59 to follow cam slots 69 and 71 respectively, which are located in each end of the frame 37. As will be described hereafter, the additional typefont 51 thereby assumes the same positional orientation as the typefont 19.

The rack 55 and the picker holders 53 may be returned to their storage position upon subsequent rightward movement of the control linkage 67. The control linkage 67 is connected to the link 73 which is in turn pinned to a shaft 75. A drive changer motor 235 (FIG. 9*b*) is connected through a clutch 241 (FIG. 9*b*) to the shaft 75 and is reversably driven to effect the raising and lowering of the rack 55.

Figure 3:
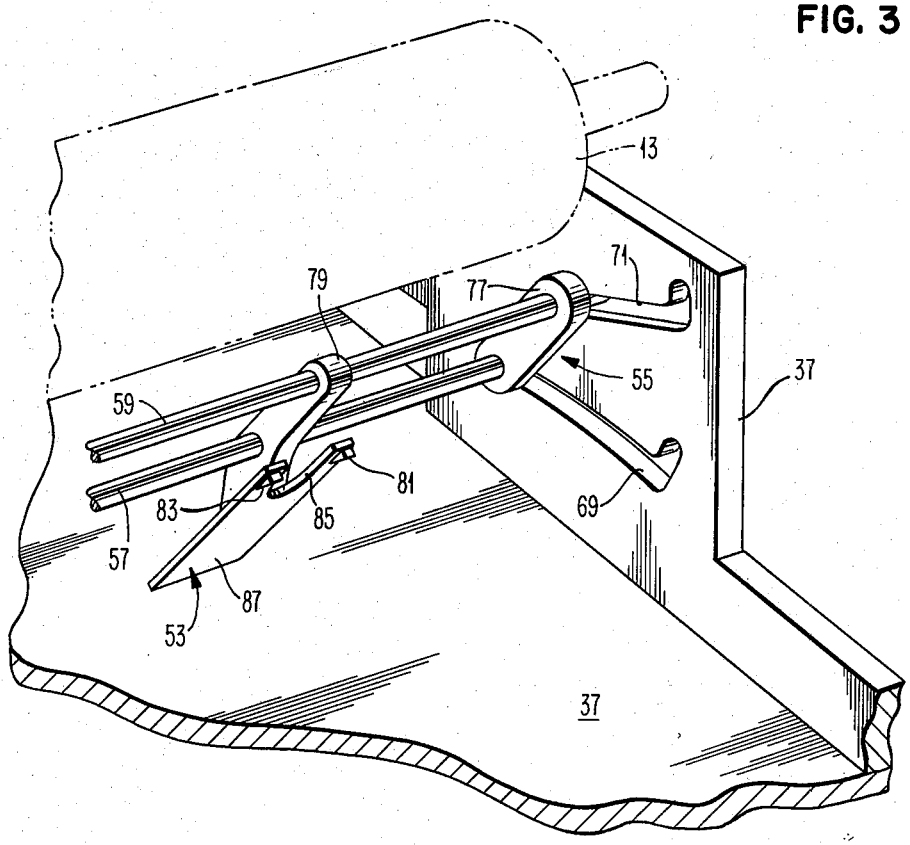
FIG. 3 is a perspective view of a portion of the picker holder rack.

Referring now to FIG. 3 of the drawing, a perspective view of a portion of the picker holder rack 55 is depicted. The tubular rack members 57 and 59 are joined by the link 77 and by the support link 79 so that they move as a unit as they move in their respective cam slots 69 and 71. The support link 79 is fixedly secured to the picker holder 53 and supports the picker holder 53 in various orientations depending upon the location of the tubular rack members 57 and 59 in their respective cam slots 69 and 71. As will be described hereafter, the picker holder 53 includes two retainer protrusions 81, 83 which are seated in matching slots 98 in the typefont 19 of FIG. 5 to prevent rotation of the typefont 19. The typefont 19 rests on the semi-circular surface 85 of the picker holder 53 when it is loaded thereon. The type petals 86 of the typefont 19 extend parallel to the surface 87 of the picker holder 53 and are thus oriented in the same direction as the surface 87 as the surface 87 changes its orientation due to the motion of the rack 55.

Figure 4:
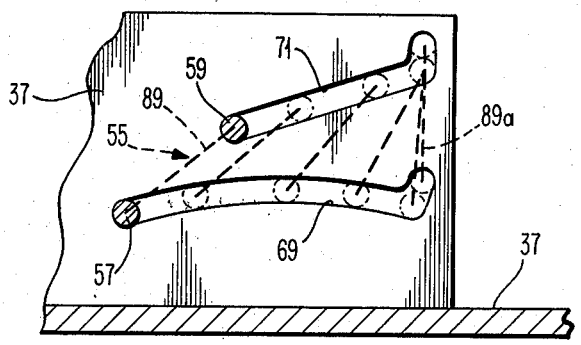
FIG. 4 is a motion diagram of the picker holder rack.

Referring now to FIG. 4 of the drawing, a motion diagram of the picker holder rack 55 is depicted. The rack 55 is shown in its first position located beneath the platen 13 of FIG. 3 whereat the tubular rack members 57 and 59 are at the leftmost positions of their respective cam slots 69 and 71. The line 89 represents the orientation of the surface 87 of the picker holder 53 of FIG. 3. The phantom line depictions of the tubular rack members 57 and 59 show their progression along their respective cam slots 69 and 71 in a rightward direction as the rack 55 is moved toward its second position whereat the typefont 19 of FIG. 1 is presented to the picker holder 53 of FIG. 3. As the rack 55 moves, the line 89 assumes a vertical orientation as depicted at 89*a*. It is further noted that the last increment of motion causes the tubular rack members 57 and 59 to move vertically upward within their respective cam slots 69 and 71. This last motion effects corresponding vertical upward motion of the picker holders 53.

Figure 5:
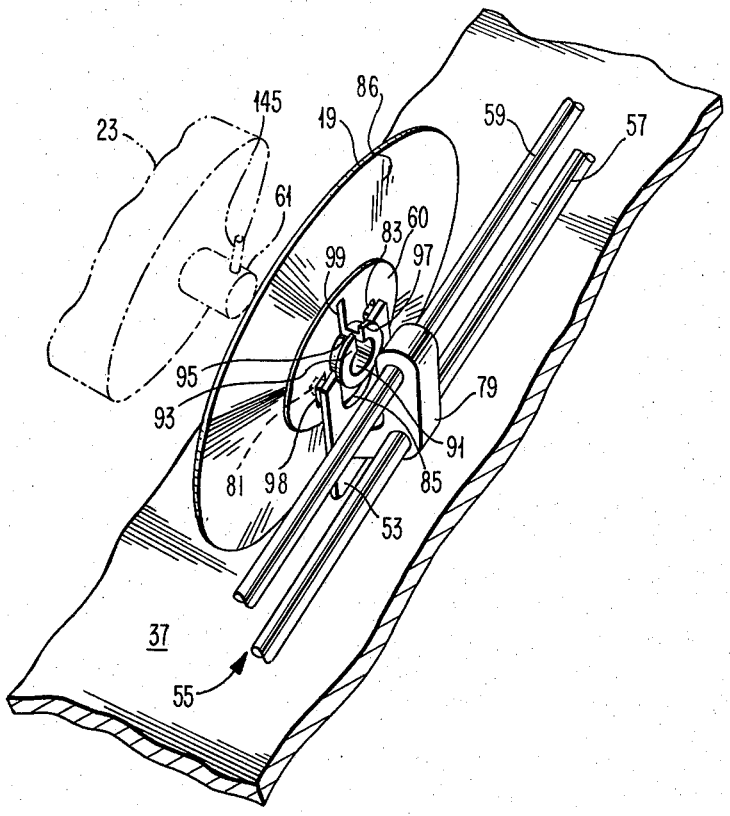
FIG. 5 is a perspective view of a picker holder during a loading operation.

Referring now to FIG. 5 of the drawing, a perspective view of a picker holder 53 during a loading operation is depicted. As depicted, the picker holder 53 has just assumed its vertical orientation and has yet to move in a vertically upward direction. As depicted for clarity purposes, the selection motor 23 has already been withdrawn. However, at this time, the daisy wheel typefont 19 is held by the motor shaft 61 of the selection motor 23, the shaft 61 extending through the annular opening 91 of the hub 60. The hub 60 also includes a grooved cylindrical member 93 extending outward from the daisy wheel typefont 19 and having an annular shaped groove 96 therein. The semi-circular surface 85 of the picker holder 53 moves upward with the rack 55 during its final vertical motion so as to mate with the groove 95. The flange 97 located adjacent to the groove 95 rests against the back surface of the picker holder 53 and is thus prevented from moving with the motor shaft 61 as it is withdrawn leftward from the annular opening 91 to the position in which it is depicted.

As described previously, the retainer protrusions 81 and 83 on the picker holder 53 rest in mating slots 98 located in the hub 60 of the daisy wheel typefont 19. The retainer protrusions 81, 83 thus prevent rotation of the daisy wheel typefont 19 when it is held by the picker holder 53. This assures that the drive pin slot 99 located in the hub 60 will align with a drive pin 145 located on the motor shaft 61 when the typefont 19 is subsequently reloaded onto the motor shaft 61.

Referring once again to FIG. 2 of the drawing, in order for the typefont 19 to become uncoupled from the motor shaft 61 during a typefont unloading operation and in order for the motor shaft 61 to become coupled with an additional typefont 51 held by a picker holder 53 during a loading operation, the motor shaft 61 must move relative to a picker holder 53 aligned therewith. Such motion is effected by moving the selection motor 23 leftward and rightward respectively over the print carrier 27. With reference to FIG. 1, a control rod 101 is connected to a hollow shaft 103 by links 104, 105 and is caused to pivot about the axis of the hollow shaft 103 when the hollow shaft 103 is rotated by the drive changer motor 235 of FIG. 9*b*. The control rod 101 unlatches the selection motor 23 as will be described and moves it rearward over the print carrier 27 to an unloading position whereat it is again latched. Reverse motion of the selection motor 23 is effected by opposite motion of the control rod 101.

Figure 6:
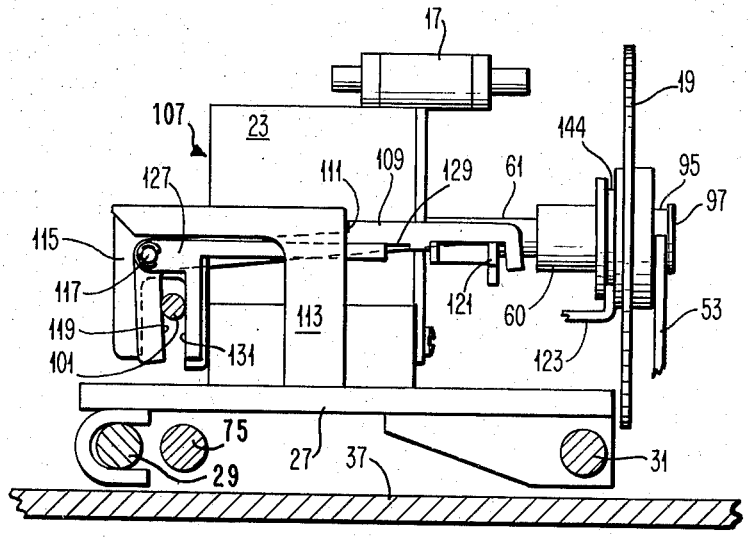
FIG. 6 is a side view of the typefont carrier.

Referring now to FIG. 6 of the drawing, a side view of the typefont carrier 107 is depicted. The typefont 19 is located on the motor shaft 61 in a position whereat printing can be effected upon actuation of the hammer unit 17. A latching bellcrank member 109 has a latch surface 111 located thereon which abuts the guide member 113 to prevent leftward motion of the selection motor 23. It is noted that the guide member 113 is fixedly secured to the print carrier 27 while the latch bellcrank member 109 is pivotally pinned to a support member 115 by pin 117. The support member 115 is fixedly secured to the selection motor 23.

When it is desired to move the selection motor 23 leftward, the control rod 101 is caused to move leftward thereby acting against surface 119 of the latch bellcrank member 109. The latch bellcrank member 109 thus pivots in a clockwise direction about the pin 117 causing its latch surface 111 to become disengaged with the guide member 113. Further, the latch bellcrank member 109 acts against linkage 121 forcing it downward. The downward motion effects corresponding downward motion of keeper member 123 as will be described. Once the latch bellcrank member 109 has rotated a fixed degree, further rotation thereof is prevented by the guide member 113. Further leftward translation of the control rod 101 thus acts to cause the latch bellcrank member 109 to translate leftward carrying with it the selection motor 23. As the selection motor 23 moves leftward, the motor shaft 61 slides through the hub 60 of the typefont 19 leaving it supported by the picker holder 53.

Figure 8:
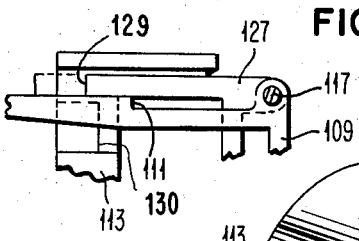
FIG. 8 is a detailed view as viewed from section lines 8—8 of FIG. 7 of a portion of the typefont carrier.

Once the selection motor 23 reaches its leftmost position, the secondary bellcrank 127 also pivotally mounted on pin 117 rotates in a clockwise direction so that its end 129 abuts a vertical surface 130 of FIG. 8 on the guide member 113. The secondary bellcrank 127 thus prevents subsequent rightward motion of the selection motor 23.

When it is desired to thereafter effect motion of the selection motor 23 toward the right in order to load a typefont 19, the control rod 101 is moved rightward effecting the counterclockwise motion of the secondary bellcrank 127 about the pin 117 causing its end 129 to clear the vertical surface 130 of FIG. 8 of guide member 113. Further rightward motion of the control rod 101 acts upon surface 131 of the secondary bellcrank 127 and support member 115 causing the selection motor 23 to translate rightward.

Figure 7:
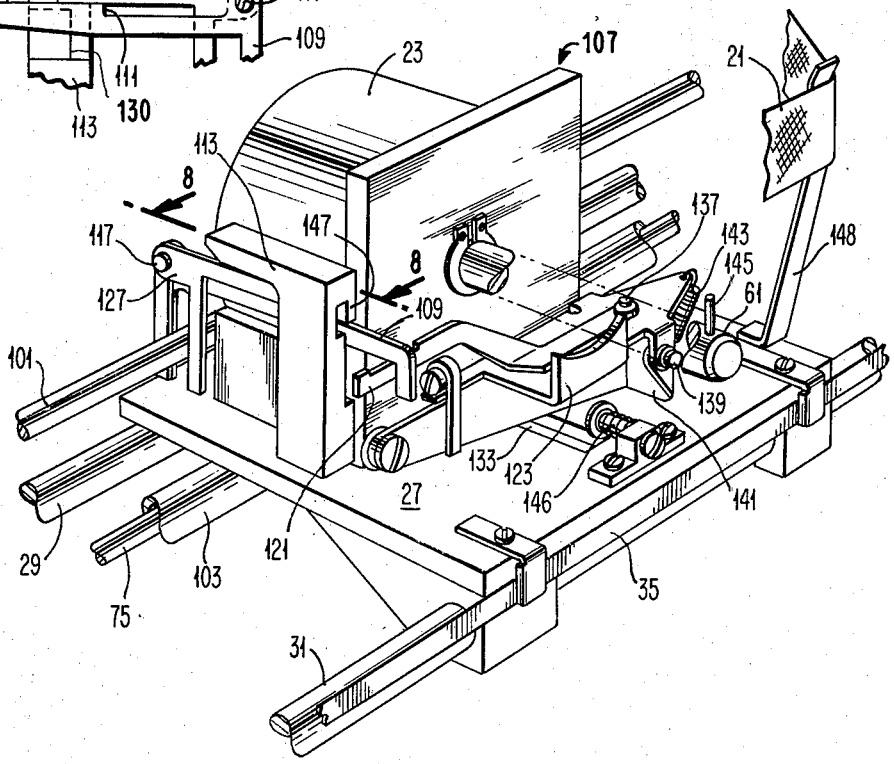
FIG. 7 is a perspective view of the typefont carrier.

Referring now to FIG. 7 of the drawing, a perspective view of the typefont carrier 107 is depicted. The selection motor 23 has been moved leftward causing the motor shaft 61 to become uncoupled from a typefront 19 of FIG. 6. A guide slot 133 is provided in the print carrier 27 to receive the selection motor 23 insuring linear motion of the selection motor 23. As depicted, the latch bellcrank member 109 has forced the linkage 121 downward. The linkage 121 is pinned to the keeper member 123 by pin 137. The keeper member 123 pivots about a pin 139 which in turn is fixedly secured to the selection motor 23 by the frame member 141. Downward motion of the linkage 121 thus causes the keeper member 123 to pivot downward about the pin 139 causing the keeper member 123 to clear the typefont 19 of FIG. 6. The spring 143 biases the keeper member 123 so that it will return to its uppermost position when the latch bellcrank member 109 no longer acts upon the linkage 121.

Referring once again to FIG. 6 of the drawing, it can be seen that the keeper member 123 rests in an annular groove 144 located in the hub 60 of the typefont 19. The keeper member 123 thus precisely locates the typefont 19 on the motor shaft 61 in its axial direction. When thusly seated in the annular groove 144, it keeps the typefont 19 from being withdrawn by the picker holder 53 as the picker holder 53 is moved to its storage position.

With reference again to FIG. 7, a drive pin 145 is pinned to the motor shaft 61 which fits in the drive pin slot 99 of the typefont 19 of FIG. 5. The drive pin 145 thus effects rotary motion of the typefont 19 as the motor shaft 61 rotates.

A spring member 146 pushes against the selection motor 23 when it is moved to its rightmost position causing the latch surface 111 of the latch bellcrank member 109 (FIG. 6) to forceably abut the surface 147 of the guide member 113.

It should be noted at this point that the ribbon 21 is supported by a ribbon guide 148 which is secured to the print carrier 27. An additional ribbon guide (not shown) as well as a conventional ribbon feed and take-up system (not shown) is also supported by the print carrier 27 so that the ribbon system remains stationary during a loading and unloading operation. It is thus necessary to lower the rack 55 during escapement motion of the print carrier 27 to prevent the additional typefonts 51, 52 located on picker holders 53 from blocking the path of movement of the ribbon 21.

Referring now to FIG. 8 of the drawing, a detailed view as viewed through section lines 8—8 of FIG. 7 of a portion of the typefont carrier 107 is depicted.

Figure 9A:
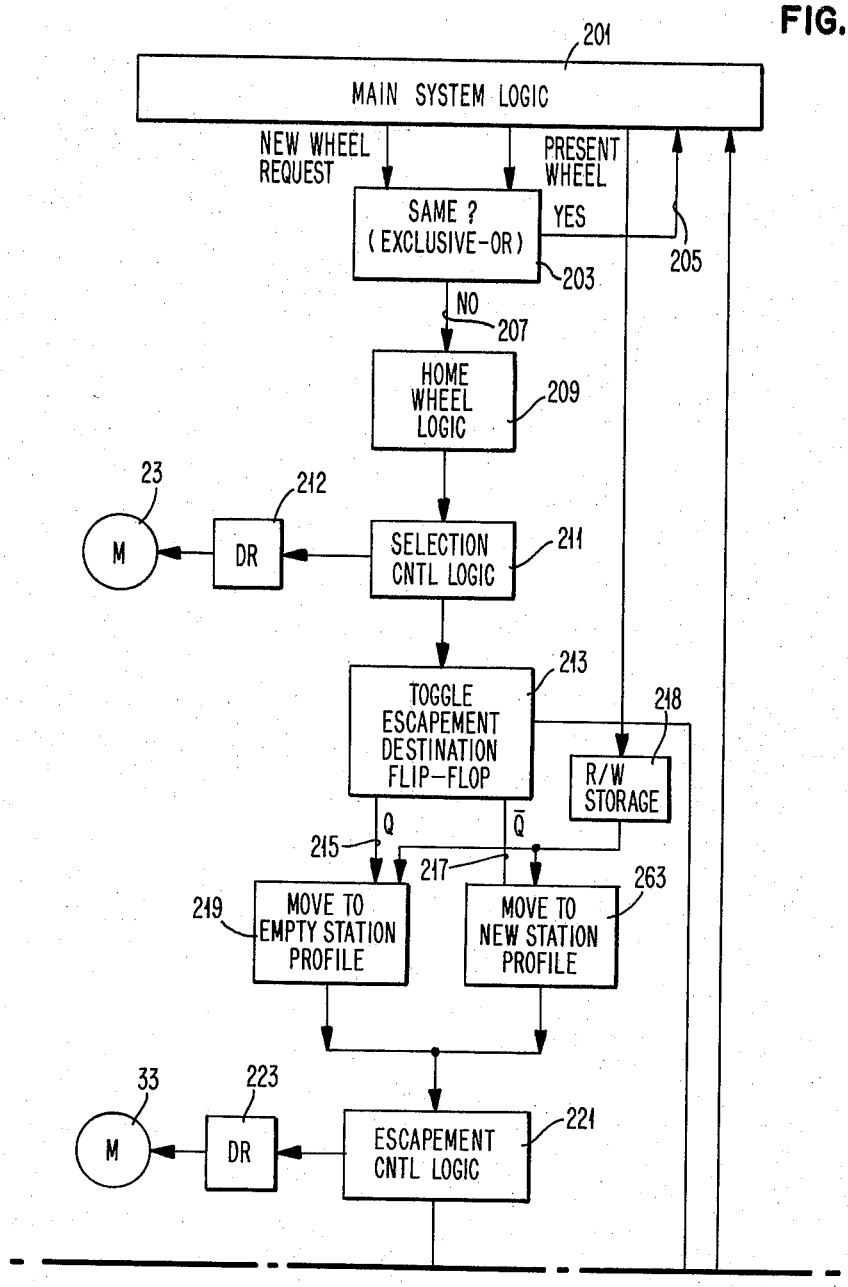
Figure 9B:
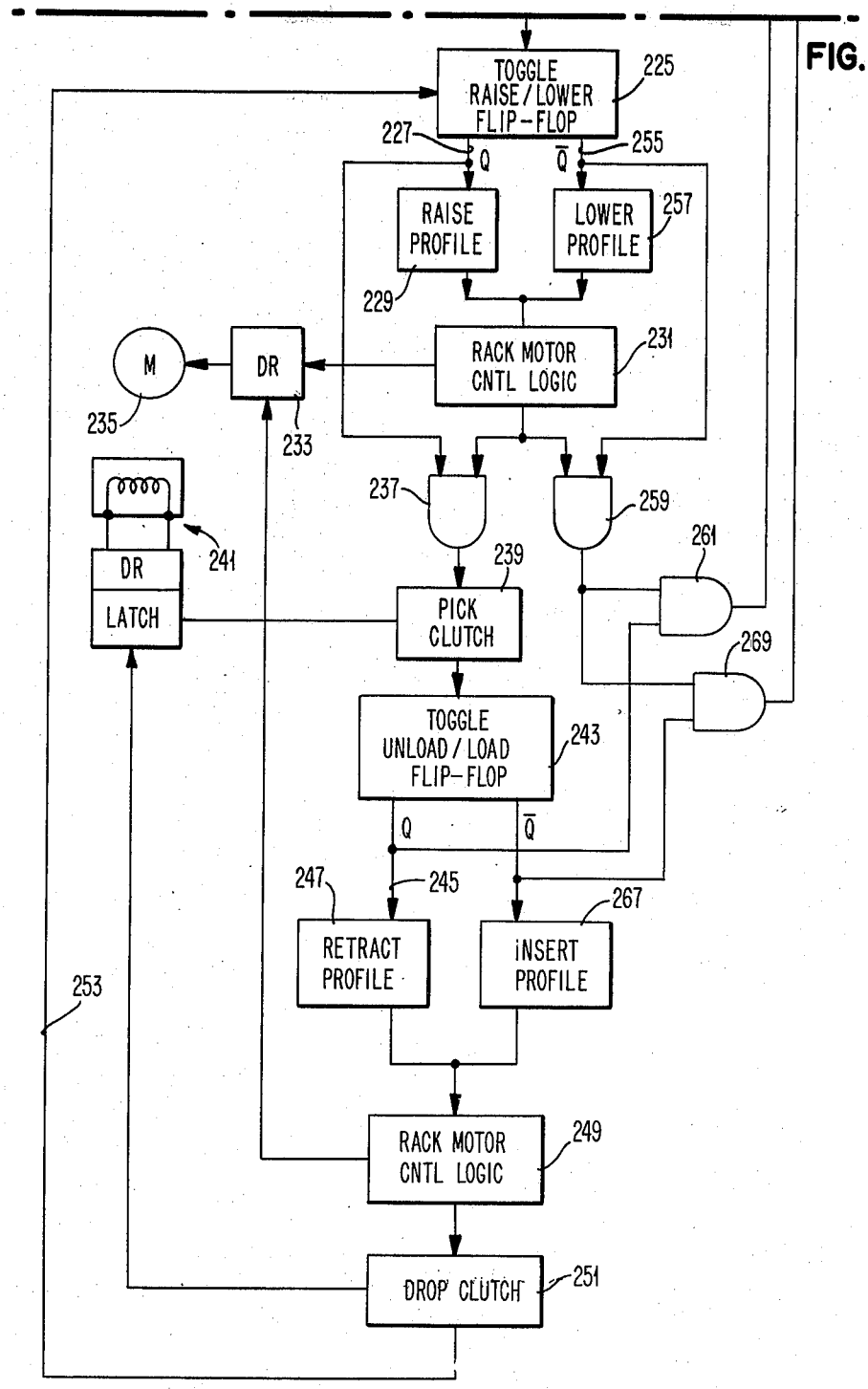

Referring now to FIGS. 9*a* and 9*b*, a logic diagram of the logic employed to sequence the typefont loading operation is depicted. Such a loading operation can be effected upon operator depression of a selected keybutton or upon the sensing of an associated code when the system is employed with an automatic printing system. In either event, the printer's main system logic 201 recognizes the request to change typefonts and prevents further printing operation. Information pertaining to the requested wheel and the wheel presently loaded on the selection motor 23 of FIG. 1 as stored in the main system logic 201 is provided to an exclusive OR circuit 203 which provides an output on line 205 if the requested wheel is the same as the present wheel. The main system logic 201 is responsive to this signal to continue printing operations.

If however, the new wheel request differs from the wheel presently employed, a signal is provided on line 207 to the home wheel logic 209. This logic 209 causes the present rotary position of the wheel to be compared with its home position (as depicted in FIG. 5) and the difference count is computed and provided to the selection control logic 211. The home wheel logic 209 utilizes the same positioning logic routine that the main system logic 201 uses to effect character selection using the home character as the selected character. The selection control logic 211 turns on a motor driver 212 to effect rotation of the selection motor 23 to thusly position the wheel at its home position. This logic 211 is the same as is conventionally utilized to position the printwheel to a desired print position. Once the printwheel is thusly positioned, a position feedback signal is applied to the toggle escapment destination flip flop 213. This causes the flip flop 213 to change state and to provide an output signal on line 215 or line 217 dependent upon its previous state. In the present description, the signal is first provided on line 215 causing the print carrier 27 of FIG. 1 to escape to the empty station whereat the picker holder 53 of FIG. 3 contains no printwheel.

In the device depicted in FIG. 1, there are four typefonts, 19, 51, 52 which may be located on corresponding picker holders 53, three of which contain typefonts 19, 51, 52 and one of which is empty. A corresponding data storage location in a read/write storage 218 is associated with each picker holder 53. Coded data indicating the typefont 19, 51, 52 held or the lack of a typefont 19, 51, 52 held is entered into the storage location and updated with each change. Once the empty storage location is determined by quering the storage locations, its escapement location can be derived from a conventional table look-up operation. Since the picker holders 53 (FIG. 3) do not move in the escapement direction, their escapement location is always the same. The same escapement logic routine which performs tab and print positioning operations on the printer 11 is employed to effect motion of the print carrier 27. Thus, the escapement location of the empty picker holder 53 position obtained from the table look-up is compared with the present escapement position of the print carrier 27. A difference value is computed by the logic block 219 and sent to the escapement control logic 221.

The escapement control logic 221 provides a signal to the driver 223 which in turn causes the stepper motor 33 to effect movement of the print carrier 27 of FIG. 1 to the position adjacent the empty picker holder 53. This is the same logic 221 which is utilized to control the stepper motor 33 during normal printing operations. A correct location feedback signal is then provided to the raise or lower flip flop 225. An output signal is provided on line 227 to cause the rack 55 of FIG. 2 to raise to its loading position. The raise profile logic 229 provides a signal to the rack motor control logic 231 which in turn causes the motor driver 233 to effect rotation of the changer motor 235. The changer motor 235 which may be the drive motor 43 or a separate motor is coupled to the shaft 75 of FIG. 1, movement of which effects the raising of the rack 55 as previously described.

Thereafter, the signal on line 227 is provided to an AND gate 237 along with the output signal from the rack motor control logic 231. The output signal of the AND gate 237 is utilized to pick a clutch as indicated by block 239. The pick clutch signal from block 239 energizes a selection clutch 241 causing the rotary output of the changer motor 235 to be uncoupled from the shaft 75 of FIG. 1 and coupled to the hollow shaft 103. The output of block 239 is also provided to the unload load flip flop 243 which provides a signal on line 245 to the motor retract profile logic 247. This logic 247 provides a signal to the rack motor control logic 249 which acting through the motor driver 233 causes the changer motor 235 to rotate. The rotary motion of the changer motor 235 is thus coupled to the hollow shaft 103 of FIG. 1 causing the selection motor 23 to move rearward as previously described. A signal is then provided to the drop clutch logic 251 causing the rotary output of the changer motor 235 to be uncoupled from hollow shaft 103 and coupled to shaft 75.

At this time, a signal is provided from the drop clutch logic 251 over line 253 to the toggle raise lower flip flop 225. This signal causes a signal to be applied on line 255 to the lower profile logic 257. This logic 257 works in the reverse manner of the raise profile logic 229 causing the rack motor control logic 231 to effect rotation of the changer motor 235 in a direction reverse from that previously utilized to thereby effect the lowering of the rack 55.

With reference to FIG. 1, at this point, the typefont 19 has been removed from the selection motor 23, the rack 55 of FIG. 2 has been lowered and the selection motor 23 has moved rearward on print carrier 27. The system is now ready to obtain the new typefont 51. The new typefont location is determined in the same manner as the empty typefont location and its position designated through the table look-up operation.

With reference to FIGS. 9*a* and 9*b* again, the signal on line 255 is applied to an AND gate 259 which gates the AND gate 261. This gate 261 effects a signal at the input to the toggle escapement destination flip flop 213 which now provides a signal on line 217 to effect movement of the print carrier 27 of FIG. 1 to a position adjacent the new type wheel. The logic 263 operates in a manner heretofore described with respect to the logic 219 causing the escapement control logic 221 to effect proper incrementing of the stepper motor 33.

The logic flow then proceeds as before through the raise lower flip flop 225 causing the rack 55 of FIG. 3 to be raised through energization of the changer motor 235. The clutch 241 is thereafter picked and the toggle load unload flip flop 243 provides an output signal to the insert profile logic 267 causing the rack motor control logic 249 to effect reverse rotation of the changer motor 235 which is now coupled through the selection clutch 241 to the hollow shaft 103 of FIG. 1 causing the selection motor 23 to move toward the selected typefont 51.

The selection clutch 241 is then dropped as indicated by block 251 and the raise lower flip flop 225 is activated to provide an output signal on line 255 effecting the lowering of the rack 55 (FIG. 3). The AND gate 259 is gated as before but now gates and the AND gate 269 because of the changed condition of the load unload flip flop 243. The output of the AND gate 269 signals the main system logic 201 that the new typefont 51 has been loaded and the system may thereafter perform further printing operations.

Referring once again to FIGS. 1 and 2 of the drawing, a system has been described wherein the selection motor 23 moves away from and toward the typefont 19 to effect loading and unloading thereof. It is, of course, recognized that the rack 55 could be constructed to move toward and away from the motor shaft 61 to effect placement thereon of a typefont 19. Further, a slidable loading mechanism or holder could be located on the motor shaft 61 to effect the exchange of the typefont 19. Although a printwheel has been described, various other shaped single element typefonts could be employed without departing from the spirit and scope of the invention.

While the invention has been particularly shown and described with reference to the preferred embodiment thereof, it will be understood by those skilled in the art that the foregoing and other changes in form and details may be made therein without departing from the spirit and scope of the invention.

What is claimed is:

1. Typefont changing apparatus and a printer comprising:

a platen for retaining a print receiving medium;

a print carrier;

positioning means for positioning said print carrier along the length of the platen to discrete printing positions;

a typefont carrying means located on said print carrier and positionable therewith for holding a typefont and for selectively presenting a preselected typeface on the held typefont to impact a document located on said platen at a printing position;

an elongated rack oriented along the length of said platen and positionable from a first position below the platen to a second loading position;

a plurality of typefont picker holder means carried by said rack along the length thereof for storing at least one typefont;

said positioning means positioning said print carrier to align said typefont carrying means adjacent a selected picker holder means;

means for elevating said rack from said first position to said second loading position for presenting said plural typefont picker holder means to said typefont carrying means for presentation or retrieval of a typefont; and, means for effecting the exchange of a typefont between said selected picker holder means and said typefont carrying means.

2. The typefont changing apparatus set forth in claim 1 wherein said means for effecting the exchange of a typefont includes means for relatively moving said typefont carrying means and said selected typefont picker holder means toward and away from each other.

3. The typefont changing apparatus set forth in claim 1 wherein said means for effecting the exchange of a typefont includes means for moving said typefont carrying means away from said selected picker holder means in order to remove a typefont from said typefont carrying means and means for moving said typefont carrying means toward said selected picker holder means in order to obtain a typefont from said selected picker holder means.

4. The typefont changing apparatus set forth in claim 1 wherein each of said picker holder means includes means for retaining a held typefont at a specific orientation.

5. The typefont changing apparatus set forth in claim 1 wherein typefonts held by said plurality of picker holder means are positioned in the same orientation in said second loading position as the typefont located on said typefont carrying means.

6. The typefont changing apparatus set forth in claim 5 wherein typefonts held by said plurality of picker holder means in said first position are oriented at an acute angle to their position when said rack is in said second loading position.

7. The typefont changing apparatus set forth in claim 1 wherein typefonts located on said plural picker holder means are located in front of said platen when said rack is positioned at said second loading position.

8. The typefont changing apparatus set forth in claim 1 further comprising logic means for retaining coded information indicating the typefont held by each picker holder means and the picker holder means which is empty of a typefont.

9. The typefont changing apparatus set forth in the claim 8 further comprising sequencing means responsive to said logic means for acting upon said positioning means to position said print carrier so that said typefont carrying means is located adjacent an empty picker holder means for signaling said elevating means to position said rack in said second loading position and for thereafter signaling said means for effecting the exchange of a typefont to effect the exchange of a typefont from said typefont carrying means to said empty picker holder means.

10. The typefont changing apparatus set forth in claim 9 wherein said sequencing means thereafter signaling said elevating means to position said rack in said first position, signaling said positioning means to position said print carrier so that said typefont carrying means is positioned adjacent a selected picker holder means, signaling said elevating means for positioning said rack in said second loading position and signaling said means for effecting the exchange of a typefont to effect the exchange of a typefont from said selected picker holder means to said typefont carrying means.

11. The typefont changing apparatus set forth in claim 1 or claim 10 wherein each of said typefont picker holder means engage an annular groove on a typefont held thereby to prevent exchange of a typefont therefrom when said rack is in its second loading position.

12. The typefont changing apparatus set forth in claim 11 further including means for moving said rack from said second loading position to said first position and wherein said typefont carrying means selectively engages a second annular groove in a typefont held thereby to prevent exchange of a typefont thereform when said rack is moved from said second loading position to said first position.

* * * * *